US006507317B1

(12) United States Patent
Kalish

(10) Patent No.: US 6,507,317 B1
(45) Date of Patent: Jan. 14, 2003

(54) RETRACTABLE ANTENNA FOR ELECTRONIC DEVICES

(75) Inventor: Alexander E Kalish, Tomball, TX (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/636,454

(22) Filed: Aug. 11, 2000

(51) Int. Cl.[7] ..... H01Q 1/24; H01Q 1/36
(52) U.S. Cl. ..... 343/702; 343/895; 455/575
(58) Field of Search ..... 343/702, 895, 343/901; 455/575, 90; H01Q 1/36, 1/24

(56) References Cited

U.S. PATENT DOCUMENTS 4,725,845 A * 2/1988 Phillips ..... 343/702
6,154,184 A * 11/2000 Endo et al. ..... 343/895
6,321,099 B1 * 11/2001 Norimatsu ..... 343/702

OTHER PUBLICATIONS

"Embedded Antennas–Technology For Next Generation Handsets", RF Design, Apr. 2000, pp. 26–31.
Satellite Experimenter's Handbook, Martin Davidoff, ©1984, pp. 6–19 and 6–20.
Satellite Experminter's Handbook, 2nd Edition, Martin Davidoff, ©1990, 4th printing, 1994, pp. 8–15 and 8–16.

* cited by examiner

*Primary Examiner*—Michael C. Wimer
(74) *Attorney, Agent, or Firm*—David L. Smith

(57) ABSTRACT

An electronic device having a retractable antenna is disclosed. The antenna is spring loaded and extends beyond the profile of the housing of the electronic device when in use. The antenna is retracted to within the profile of the housing of the electronic device when not in use. Preferably the antenna is spring loaded to move from the retracted position to the extended position upon actuation. Preferably, the antenna is a quadrifilar antenna. The antenna may be incorporated in an on-off switch.

10 Claims, 4 Drawing Sheets

RETRACTABLE ANTENNA FOR ELECTRONIC DEVICES

TECHNICAL FIELD

This invention relates generally to antennas, and in particular to a retractable antenna for electronic devices.

BACKGROUND OF THE INVENTION

An antenna is a lossy transducer that transforms energy from one form to another. Antennas are employed to transmit or receive radio frequency (RF) electromagnetic radiation. The same antenna may be used to both transmit and receive RF energy. As a transmit antenna, an antenna receives electrical energy from a source, such as a feed line coupled to the antenna, and radiates the received electrical energy less some loss into the space surrounding the antenna. As a receive antenna, the antenna converts electrical energy from the space surrounding the antenna into electrical energy and couples the induced electrical energy to a feed line coupled to the antenna. Electronic devices, particularly portable devices such as portable or cellular telephones, two-way radios, and personal digital assistants, interface with each other through, inter alia, RF communications using such standards as IEEE 802.11, Bluetooth, and others.

Electronic devices generate RF noise that may be coupled to an antenna thereon. Cell phones and radios have employed sliding or telescoping antennas to extend the antenna to an appropriate length or provide for greater signal reception. Such extending antennas do not reduce noise pick-up.

It would be desirable to have an antenna on an electronic device that can be positioned so as not to be electromagnetically coupled to noise generating sources of the electronic device.

SUMMARY OF THE INVENTION

In accordance with an illustrative embodiment of the invention, an electronic device includes a retractable antenna. The antenna is spring loaded and when in use extends beyond the profile of the housing of the electronic device. The antenna is retracted to within the profile of the housing of the electronic device when not in use. Preferably the antenna is spring loaded to move from the retracted position to the extended position upon actuation. In one embodiment, the antenna is a quadrifilar antenna. The antenna may be incorporated in an on-off switch.

DETAILED DESCRIPTION

Figure 1:
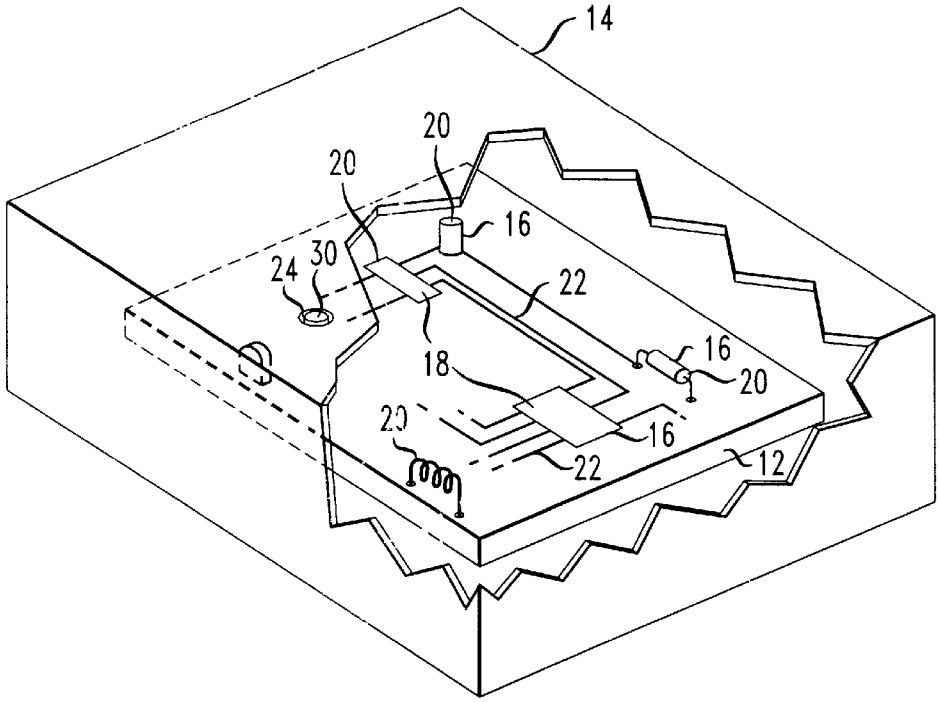
FIG. 1 is diagram of an electronic device incorporating a retractable antenna in accordance with the invention.

A schematic diagram of an electronic device 10 in accordance with an illustrative embodiment of the present invention is shown in FIG. 1. The invention may be used in electronic devices including but not limited to personal digital assistants, laptop computers, printers, cell phones, cordless phones and base units. Electronic device 10 includes one or more circuit boards 12 mounted within housing 14. Housing 14 may be made of such materials as metal or plastic. Electrical components 16, such as integrated circuits 18 and discrete components 20, mounted on circuit board(s) 12 are interconnected by traces 22. During operation of electronic device 10, electromagnetic fields are developed in the proximity of the electrical components and traces. The electromagnetic fields induce unwanted signals, known as noise, in components and traces with which they interact.

It is undesirable to locate an antenna within housing 14 proximate the circuit board(s) 12, because electromagnetic coupling between the electrical components or traces and the antenna induces noise on signals received by or transmitted from the antenna. Through experimentation, a location for an antenna could be determined in an electronic device that minimizes the noise. However, this technique may result in a location that has gaps in radial coverage of the antenna during either reception or transmission.

In accordance with the invention, a retractable antenna 30 is mounted in housing 14. Retractable antenna 30 may be extended beyond the profile of housing 14 when the antenna is being used, and may be retracted to be substantially within the profile of housing 14 when the antenna is not in use. To be within the profile of housing 14 means to be substantially within the outer surface of housing 14. This does not mean the antenna would retract between intermittent uses. In this manner, when housing 14 is a conductive material that provides shielding, retractable antenna 30 in the extended position is less susceptible to noise generated within housing 14.

Figure 2:
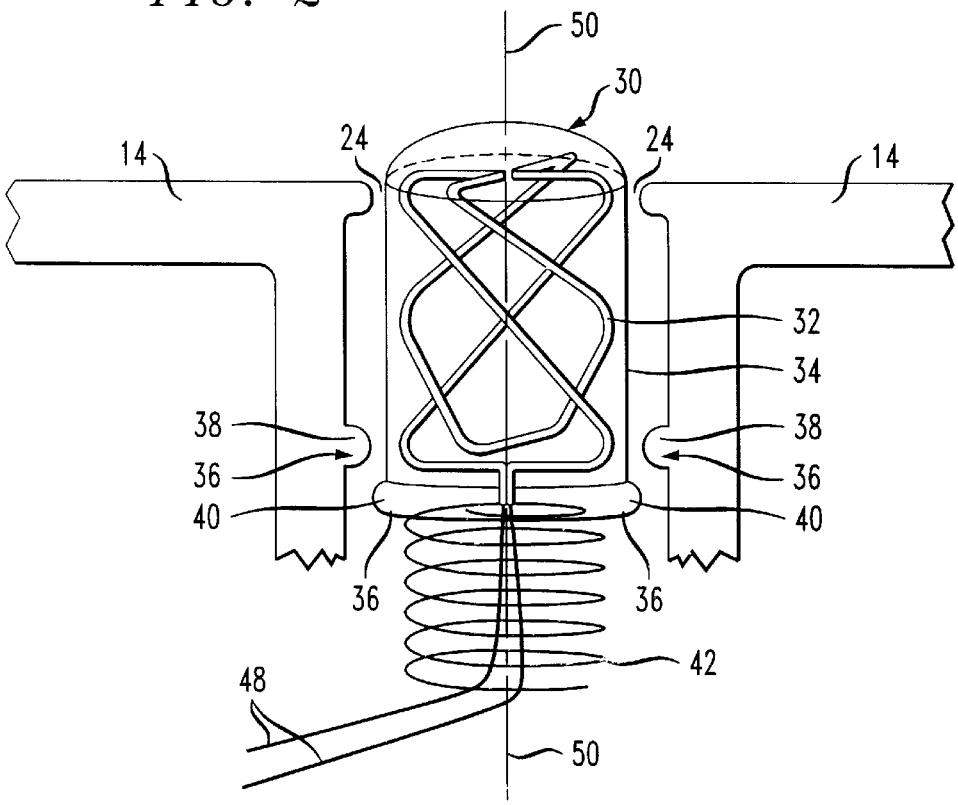
FIG. 2 is an enlarged partial cross sectional view, partially cut away, of a portion of the electronic device showing the retractable antenna in the retracted position.
Figure 3:
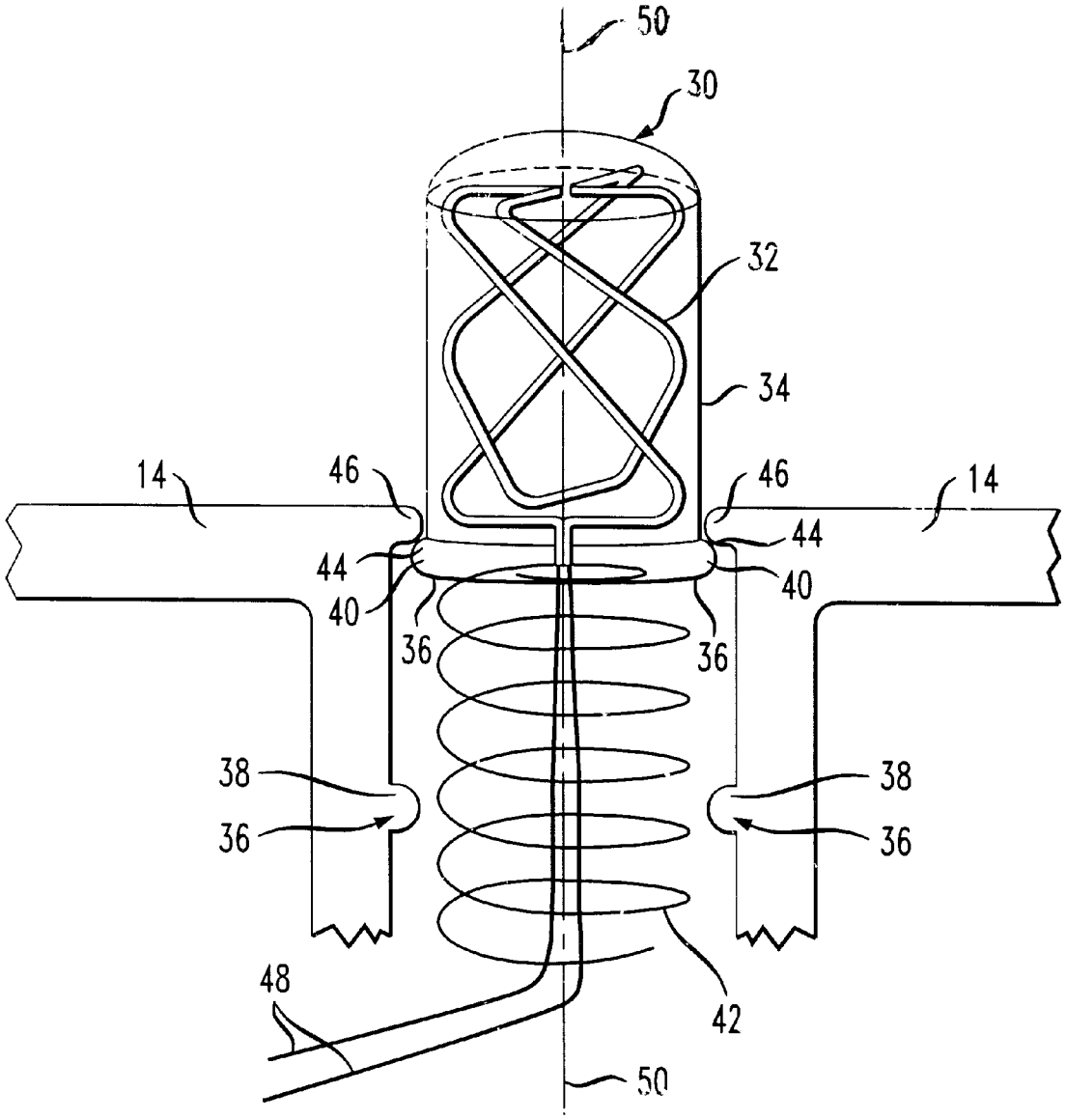
FIG. 3 is an enlarged partial cross sectional view, partially cut away, of a portion of the electronic device showing the retractable antenna in the extended position.

Retractable antenna 30 is shown in greater detail in FIGS. 2 and 3. In FIG. 2, retractable antenna 30 is illustrated retracted to be substantially within the profile of housing 14. Retractable antenna 30 is illustrated as an antenna conductor 32 within a non-conductive antenna housing 34. The antenna housing 34, which could be molded plastic, is sized and shaped to cooperate with an aperture 24 in housing 14. For example, antenna conductor 32 could be over-molded in a plastic to form a cylinder. A latch 36, having cooperating latch portions 38 on housing 14 and 40 on antenna housing 34, retains retractable antenna 30 in the retracted position. One skilled in the art would know how to design a latch to provide the retention function. In the retracted position, a portion of retractable antenna 30 may extend beyond the profile of housing 14 to permit activation by human touch.

A spring 42 provides a force to move antenna housing 34 outward beyond the profile of housing 14 when latch 36 is released. Upon pressing antenna housing 34 back into housing 14 from an extended position, spring 42 is compressed, storing energy therein for subsequently extending antenna housing 34 upon release of latch 36. Retractable antenna 30 is extensible and retractable along axis 50, which may be the axis of a cylindrical form when antenna housing 34 takes the form of a cylinder as described above. Preferably, spring 42 is made of a non-conductive material, such as plastic if in the proximity of retractable antenna 30, or if mounted remotely from retractable antenna housing 34, spring 42 may be made of a conductive material.

In FIG. 3, retractable antenna 30 is illustrated extending beyond the profile of housing 14. As best seen in FIG. 3, catch 44 on antenna housing 34 cooperates with an extension 46 on housing 14 to prevent retractable antenna 30 from extending there-beyond and falling out of housing 14.

Antenna conductor 32 may be looped within antenna housing 34. Antenna conductor 32 is the antenna that radiates energy during transmissions and converts electrical energy from the surrounding space into a received electrical signal.

In a preferred embodiment, antenna conductor 32 forms a quadrifilar antenna constructed of four loops of subminiature coaxial cable center conductor, although the invention is not limited thereto. A quadrifilar antenna at the frequencies of interest is a compact antenna design in which the antenna conductor occupies a small space by being looped, such as a helical loop.

A quadrifilar antenna for operation in the 2.4 gigahertz band could be insert molded in a cylindrical antenna housing 34 of approximately 1.87 centimeters in diameter and 2.77 centimeters in height. Since wavelength and frequency of a carrier signal are inversely proportional, as the frequency is increased, a shorter antenna is employed. For operation in the 5.0 gigahertz band, a cylindrical antenna housing 34 of approximately 0.877 centimeters in diameter and 1.33 centimeters in height could accommodate a quadrifilar antenna. Antenna housing 34 would become larger for lower frequencies. This design would suffice for frequencies greater than about 200 megahertz.

A flexible feed line 48 coupled to the antenna conductor 32 provides an electrical path to interconnect the antenna conductor 32 with circuitry on circuit board(s) 12. Feed line 48 provides a path for electrical energy being transferred from circuit boards 12 to an antenna conductor 32 when the antenna operates as a transmit antenna. Feed line 48 also provides the path for signals induced in the antenna in receive mode to pass to circuitry on circuit boards 12 for further processing.

Figure 4:
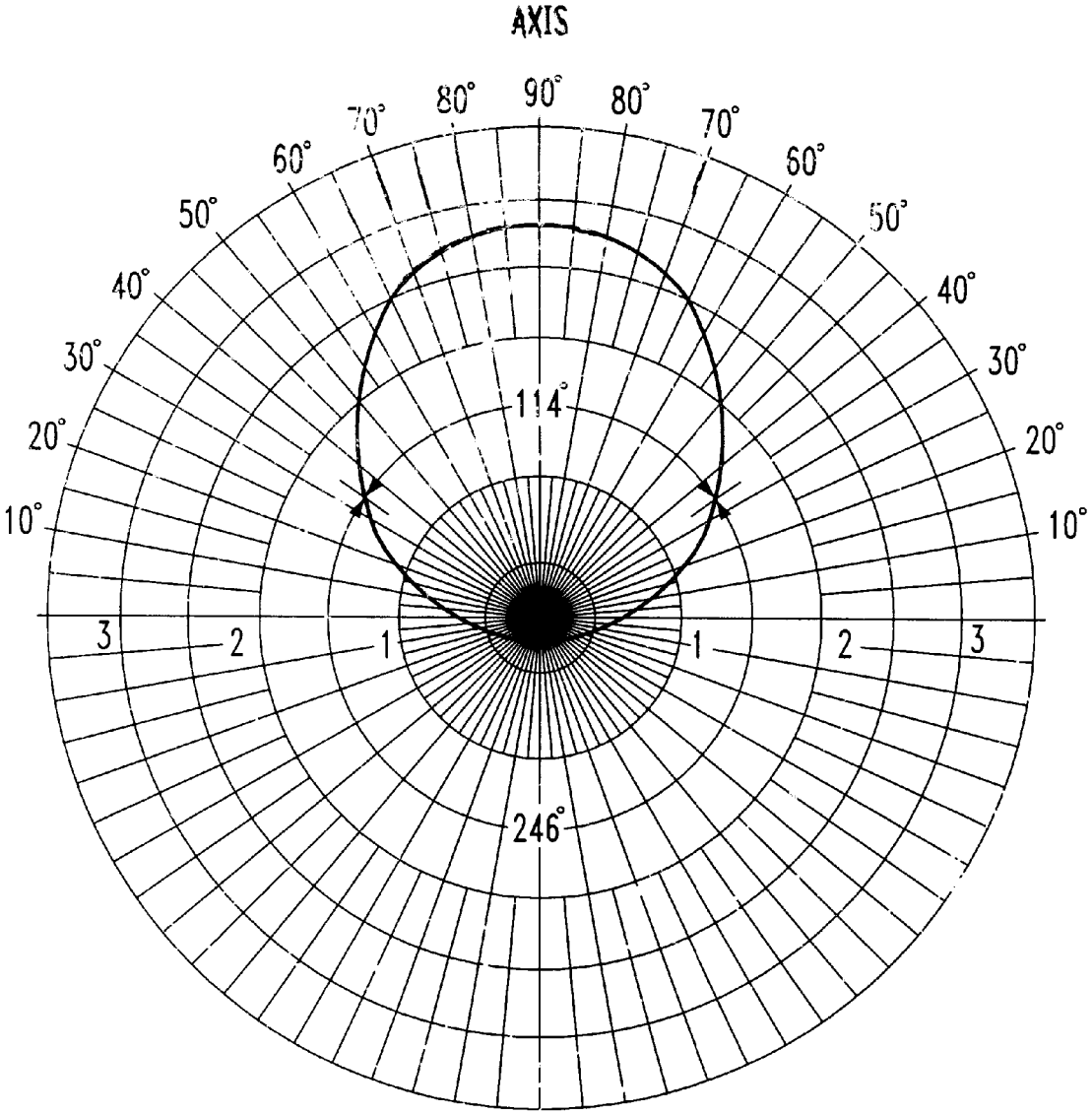
FIG. 4 is a diagram of the power gain pattern, in arbitrary units, of a quadrifilar antenna.

Retractable antenna 30 is positioned on housing 14 such that at least in the extended position, the power gain pattern of quadrifilar retractable antenna 30 is positioned electromagnetically clear of electromagnetic noise emanating from housing 14. The power gain pattern, in arbitrary power units, is shown in FIG. 4. The power gain pattern is published at page 8–15 of the Satellite Experimenter's Handbook, $2^{nd}$ edition, written by Martin David off and published in 1990. The disclosure of the Satellite Experimenters Handbook is hereby incorporated by reference.

On the power gain pattern shown in FIG. 4, axis 50 of retractable antenna 30 is represented at the 90° position with the bottom of the antenna where it couples to flexible feed line 48 being the horizontal line representing 0°. It is noteworthy that approximately 114° of the power gain pattern of a quadrifilar antenna have a greater than unity gain. More importantly, any signals impinging on antenna 30 in the approximately 246° attenuated portion of the power gain pattern are attenuated due to the antenna gain being less than unity in this region of the antenna power gain pattern. The approximately 246° attenuated portion of the power gain pattern is that portion of the antenna power gain pattern that is within approximately 38° to horizontal, or below horizontal, relative to the axis and bottom of the antenna, where the antenna gain is less than unity.

Mounting retractable antenna 30 on housing 14 with axis 50 oriented such that electromagnetic noise from electronic device 10 received at antenna 30 from electronic device 10 is totally or substantially within the approximately 246° attenuated portion of the power gain pattern of the antenna assures that noise received at antenna 30 from housing 14 is attenuated. In this manner, the position of the antenna, in conjunction with the power gain pattern of the antenna, limits the noise received on the antenna from electronic device 10 and improves the signal-to-noise ratio of signals received by the antenna. Employing the invention, it is not necessary to rely on mechanical shielding, such as may be provided by a metal enclosure or an enclosure with a conductive coating, to reduce electromagnetic noise from electronic device 10.

While the disclosed antenna has been described as a quadrifilar antenna, other antennas having a power gain pattern that includes a wide angle of attenuation in the power gain pattern would suffice. The wide-angle of attenuation need not be 246° as with a quadrifilar antenna. Preferably, the angle of attenuation is a sufficiently wide angle, relative to the location of the antenna on the housing, that the antenna can theoretically be positioned at any location within a large area of the housing and effectively attenuate electromagnetic noise emanating from the housing that impinges thereon. An antenna power gain pattern angle of attenuation need not be greater than 180°, and may be less than 180°. An angle of approximately 180° would assure an antenna could be placed anywhere on a surface of housing 14. A smaller angle may suffice, depending on the location of the noise generating devices within electronic device 10. Such an antenna could be positioned on housing 14 to receive noise at the antenna from electronic device 10 within the attenuated portion of the power gain curve, while providing a gain of unity or greater for signals received through other portions of the power gain curve. Such an antenna improves the signal-to-noise ratio of the received signal.

Figure 5:
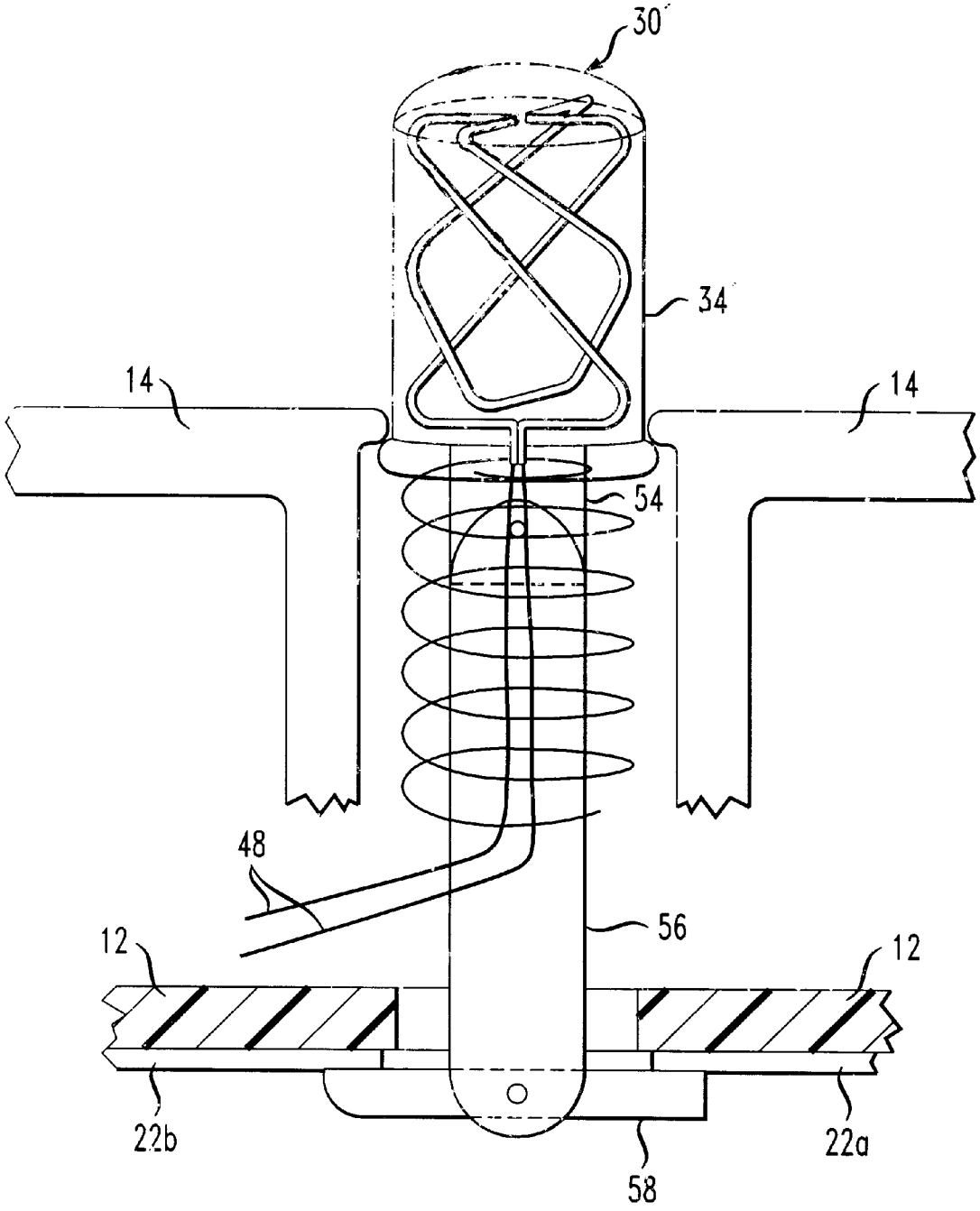
FIG. 5 is an enlarged partial cross sectional view, partially cut away, of a portion of the electronic device showing the retractable antenna integral with an on/off switch for the electronic device.

FIG. 5 illustrates an alternate embodiment retractable antenna 30' in which antenna housing 34' includes an integral on-off switch 58 for electronic device 10. Antenna housing 34' is movable from a retracted position within housing 14 to an extended position beyond the profile of housing 14, as described above with respect to antenna housing 34.

Antenna housing 34' illustrated in FIG. 5 includes an extension 54 pivotally coupled to link 56 at a first end thereof. A second end of link 56 is pivotally coupled to and actuates a switch 58 between traces 22*a* and 22*b*. Switch 58 is closed and thus completes the circuit formed by traces 22*a* and 22*b* to provide power to electronic device 10 when antenna housing 34' is in the extended position. Switch 58 is opened and thus interrupts the circuit formed by traces 22*a* and 22*b* and hence the power to electronic device 10 when antenna housing 34' is in the retracted position. Incorporating the antenna and the on-off switch in a single function assures that the antenna is deployed when electronic device 10 is powered and is retracted when electronic device 10 is not powered. In this manner antenna housing 34' is extended beyond the profile of housing 14 when electronic device 10 is powered, and antenna housing 34' is retracted to be within the profile of housing 14 when electronic device 10 is not powered.

Although one type of mechanical on-off switch has been shown, one skilled in the art could develop other on-off power switch techniques, mechanical or otherwise, integral with the antenna.

What is claimed is:

1. An electronic device, comprising:

a housing having an aperture to accommodate passing an antenna therethrough;

a retractable quadrafilar antenna mounted in the housing proximate the aperture, the retractable antenna capable of being extended beyond the profile of the housing when in use, and capable of being retracted to within the housing when not in use, the quadrafilar antenna being spring-loaded to move the quadrafilar antenna to the extended position, energy being stored in a spring-loaded mechanism upon the quadrafilar antenna being retracted to within the housing;

a latch having cooperating parts on the retractable quadrafilar antenna and on the housing, the latch capable of securing the retractable quadrafilar antenna in the retracted position; and an on-off switch, the on-off switch integral with the quadrifilar antenna, the on-off switch capable of completing a circuit to provide power to the electronic device when the quadrafilar antenna is extended beyond the profile of the housing, and capable of interrupting the circuit that provides power to the electronic device when the quadrafilar antenna is retracted within the housing.

2. An electronic device as recited in claim 1, wherein the spring-loaded mechanism is a spring.

3. An electronic device as recited in claim 2, wherein the spring is made of a nonconductive material.

4. An electronic device as recited in claim 2, wherein the spring is located remote from the antenna and is made of a conductive material.

5. An electronic device as recited in claim 1, wherein the antenna is a designed to operate at frequencies greater than 200 megahertz.

6. An electronic device, comprising:

a housing having an aperture to accommodate passing an antenna therethrough;

a retractable quadrafilar antenna mounted in the housing proximate the aperture, the retractable quadrafilar antenna capable of being extended beyond the profile of the housing when in use, and capable of being retracted to within the housing when not in use, the quadrafilar antenna being spring-loaded to move the quadrafilar antenna to the extended position, energy being stored in a spring-loaded mechanism upon the quadrafilar antenna being retracted to within the housing, the spring-loaded mechanism being located remote from the quadrafilar antenna;

a latch having cooperating parts on the retractable quadrifilar antenna and on the housing, the latch capable of securing the retractable quadrifilar antenna in the retracted position; and an on-off switch, the on-off switch integral with the quadrafilar antenna, the on-off switch capable of completing a circuit to provide power to the electronic device when the quadrafilar antenna is extended beyond the profile of the housing, and capable of interrupting the circuit that provides power to the electronic device when the quadrafilar antenna is retracted within the housing.

7. An electronic device as recited in claim 6, wherein the spring-loaded mechanism is a spring.

8. An electronic device as recited in claim 7, wherein the spring is made of a nonconductive material.

9. An electronic device as recited in claim 7, wherein the spring is located remote from the antenna and is made of a conductive material.

10. An electronic device as recited in claim 6, wherein the antenna is designed to operate at frequencies greater than 200 megahertz.

* * * * *